United States Patent [19]

Currie

[11] 4,085,933

[45] Apr. 25, 1978

[54] SPRING-HOOK DEVICE FOR SCORING IN A TARGET TYPE GAME

[76] Inventor: David W. Currie, 1552 Wittekind Terrace, Cincinnati, Ohio 45224

[21] Appl. No.: 754,333

[22] Filed: Dec. 27, 1976

[51] Int. Cl.[2] ..... A63B 71/00

[52] U.S. Cl. ..... 273/95 R; 273/106 R

[58] Field of Search ..... 273/95 R, 95 E, 1 R, 273/106 R, 106.5 A, 101; 46/129; 124/7

[56] References Cited

U.S. PATENT DOCUMENTS

| | | | |
|---|---|---|---|
| D. 30,032 | 1/1899 | Weigelt et al. | 46/129 X |
| 712,159 | 10/1902 | Voege | 273/1 R X |
| 771,943 | 10/1904 | Spicer | 273/95 R |
| 1,329,201 | 1/1920 | Neyd'Hart | 46/129 |
| 1,542,012 | 6/1925 | Spilman | 46/129 X |
| 1,542,063 | 6/1925 | Knight | 273/95 R X |
| 1,693,277 | 11/1928 | Hustwick | 273/95 E |
| 3,612,528 | 10/1971 | Glass et al. | 273/95 R |
| 3,675,924 | 7/1972 | Smith | 273/101 |
| 3,715,121 | 2/1973 | Renn et al. | 124/7 X |
| 3,784,200 | 1/1974 | Hotchkiss | 273/95 R |

FOREIGN PATENT DOCUMENTS

| | | | |
|---|---|---|---|
| 6,943 of | 1904 | United Kingdom | 273/95 R |
| 3,345 of | 1905 | United Kingdom | 273/106 R |

*Primary Examiner*—William H. Grieb

*Attorney, Agent, or Firm*—Melville, Strasser, Foster & Hoffman

[57] ABSTRACT

A game apparatus consisting of an open cup or box-shaped receptacle used as a target for a unitary spring-hook device which after it has been launched by applied pressure and released arches forward in a spin and hooks itself on the raised edge of the target receptacle, when not missing the receptacle or falling into it.

6 Claims, 16 Drawing Figures

SPRING-HOOK DEVICE FOR SCORING IN A TARGET TYPE GAME

BACKGROUND OF THE INVENTION

1. Field of the Invention

This invention relates to target games of the type wherein a projectile is projected into a target member.

2. Description of the Prior Art

There are many kinds of target games, most of which involve a projectile which is tossed, hurled, shot, flipped or launched by one means or another at the target. The projectiles, themselves, come in may shapes and forms, such as basketballs, bowling balls, flying discs, javelins, arrows, darts, bullets, tiddlywinks, etc. However, in general table-top target games may be divided into two groups:

1. Those which require two or more separate entities as a device to motivate a projectile toward the target. Exemplary of such devices is tiddlywinks, when one wink is pressed against another resting on a piece of felt in such a way as to cause it to slip out from under the pressure and flip forward toward the target. A further exemplary device is shown in U.S. Pat. No. 1,542,063, in the name of Knight, wherein a bottle-like projectile is thrown at its target by an adjustable catapult.

2. Those which are unitary devices and contain within themselves the motive force such as a spring which, when released after pressure, launches the device towards the target. Exemplary unitary devices can be seen in U.S. Pat. Nos. 3,784,200, Hotchkiss; 3,612,528, Glass; and 1,329,201, Neyd'hart.

While prior art table-top target games have been successful, it is always necessary to develop new and challenging devices to meet new and more wide spread interests.

SUMMARY OF THE INVENTION

The subject of the present invention relates to the aforementioned second group of table-top target games. For purposes of comparison, it can be described as a leaf spring, catapult-action device, wherein the entire body of the catapult becomes the projectile when its spring structure is pressed and released. Its spring frame provides two or more ways to activate its motive force and is so structured to provide more than one way of scoring after being launched.

Broadly considered, the projectile of the present invention is defined by a base and fork having bifurcations extending in a common plane which curves rearwardly to form a twin hook. The body of the projectile is composed of a resilient material that allows the projectile to act as a spring which when pressed and released can launch the entire projectile toward a target. The target comprises a receptacle having a raised edge which the projectile can hook upon when not missing the receptacle or falling into it.

The projectile of the present invention incorporates two means of scoring during game play; namely, (1) as a projected body into the target receptacle; and (2) as a projectile that can readily hook and latch itself onto the raised edge of the target receptacle.

The projectile of the present invention may be launched with the wall of the two hooks facing down, or facing upwardly, with each position requiring a different technique and finger manipulation of the resultant configuration.

The projectile of the present invention provides several ways to activate its motive force by pressure and release and contains within its spring structure more than one means of scoring. Its structure is simple and inexpensive to manufacture; its entire body serving as both of its motive force and structural utility. The projectile of the present invention requires far less material in its construction than other prior art devices, and because of the variety of ways it can be launched, it provides opportunities for the development of techniques and skills offered by no other projectile table-top target game presently known in the art. In summary, the projectile for a table-top target game receptacle of the present invention provides an inexpensive, unitary spring-hook device to be used in game play, which, because of its structure, may be launched in more than one way and with more ease, may fly with more stability, and may be aimed with more accuracy, and which contains within its spring structure the means to readily hook and latch itself upon the raised edge of a target receptacle when not missing the receptacle or falling into it. The projectile of the present invention provides a clear and demonstrable advantage in the flight distance of the projectile when compared on ratio basis of spring, weight and distance to target; variety in launch capability; demonstrably better control during pressure and release at launch; a more integrated center of gravity resulting in: better balance, less spinning wobble, and higher accuracy; more than one defined means of scoring innate in the spring structure of the projectile; less handling discomfort during continuous game play; and inexpensive to manufacture because it uses less material in its frugal construction and when made by a molding device or stamping device, the cost of these devices is considerably less as a result of the simplicity of design and its single-unit structure.

DESCRIPTION OF THE PREFERRED EMBODIMENTS

Figure 1A:
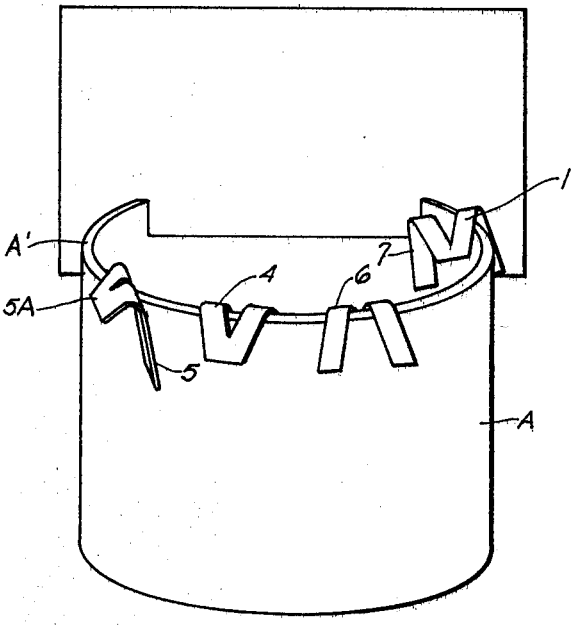
FIGS. 1A and 1B are schematic views of the game of the present invention being played with two kinds of receptacles.
Figure 1B:
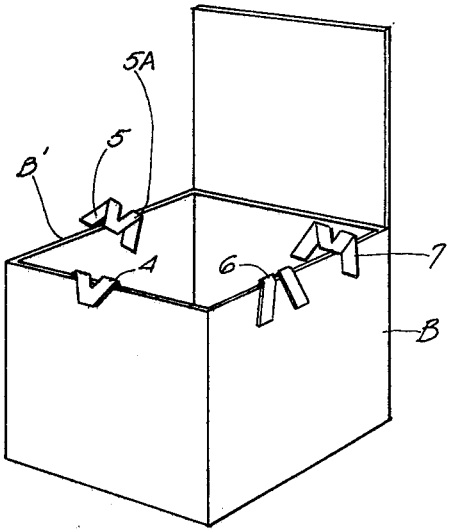
Figure 2A:
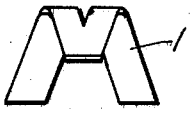
FIG. 2A is a plan view of a preferred embodiment of the projectile of the present invention.
Figure 2B:
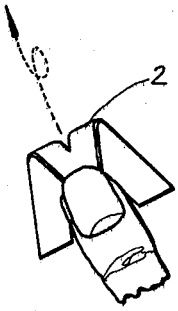
FIG. 2B is a plan view of the projectile of FIG. 2A showing it being launched.
Figure 2C:
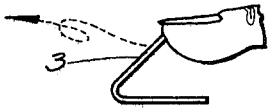
FIG. 2C is a side elevational view of the projectile of FIG. 2B.

FIGS. 1A and 1B disclose versions of the game of the present invention being played with two kinds of receptacles, a circular recptacle A and a square or rectangular receptacle B, with the projectile 1 being launced in a forward rolling hook from a hooks down 2 and 3 launch position, as shown in FIGS. 2B and 2C. This kind of launch is called a "shot".

Figure 3A:
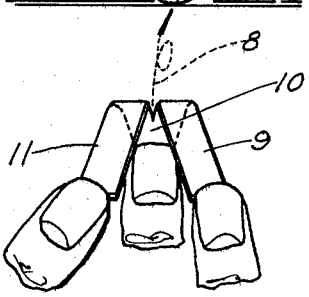
FIG. 3A is a plan view of the projectile of FIG. 2A being launched in another manner.
Figure 3C:
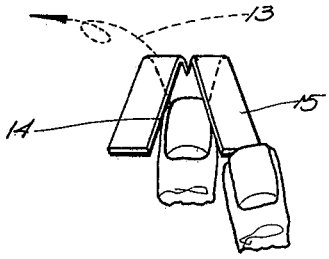
FIG. 3C is a view similar to FIG. 3A showing a further launching manner.
Figure 3B:
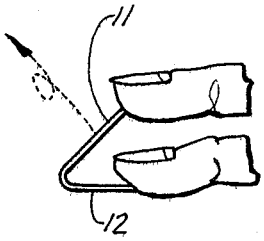
FIG. 3B is a side elevational view of the projectile of FIG. 3A.
Figure 4A:
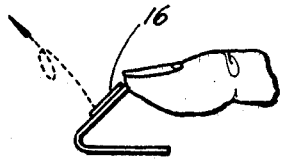
FIGS. 4A, 4B, 5A, 5B, 6, 7, 8 and 9 are figures showing further embodiments of the projectile of the present invention which may be used because their form takes the shape of trademarks, alphabet letters, or symbols of business who desire to advertise using the projectile of the present invention as a vehicle which would then double as a game piece, etc.
Figure 4B:
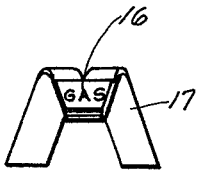
Figure 5A:
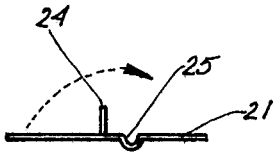
Figure 5B:
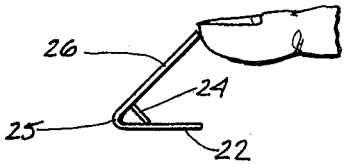
Figure 6:
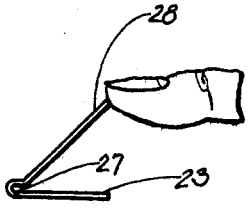
Figure 7:
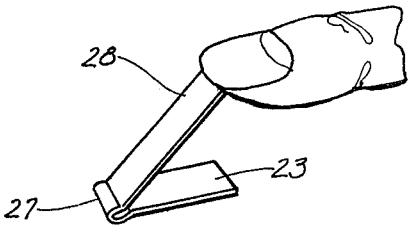
Figure 8:
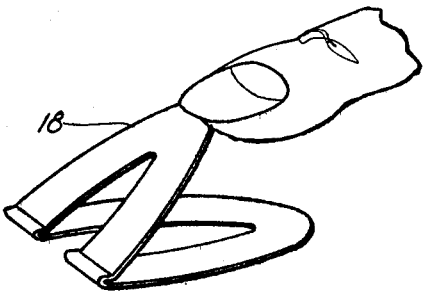
Figure 9:
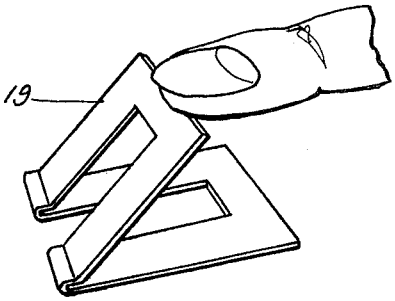

FIGS. 3A, 3B and 3C dislcose the preferred projectile 1 of the present invention being launched in two ways 8 and 13 from a hooks up position: one with both hooks 9 and 11 being pressed down by two fingers, with a third finger holding the base 10 and 12 of the fork which becomes the release point from which the projectile is launched by slipping out from under the downward pressure on the hooks 9 and 11 and flying up and forward 8 in a reverse rolling hook. This kind of launch is called a "doublet". The second launch 13 is shown in FIG. 3C, with one hook 15 being pressed down while a second finger 14 holds the base of the fork which becomes the release point from which the projectile is launched by slipping out from under the downward pressure on the pressed hook and flying up and forward 13 in a reverse rolling hook. This kind of launch is called a "sidewinder".

The remaining figures of the drawing disclose examples of other embodiments of the projectile of the present invention which may be used because their form takes on the shape of trademarks, or alphabet letters 16, 17, 18, 19, 20, 21, 22, 23 which are symbols of businesses which desire to advertise using the projectile of the present invention as a vehicle which would then double as a billboard and game piece, the game piece making its possession desirable to potential customers of the business. Such embodiments lack the hooking ability, lightness and control of the preferred embodiment of FIGS. 2A, 2B, and 2C.

Since premium items require compactness so they can be easily packaged with or attached to the "for sale item," the projectile of the present invention may be made flat 21 with a plastic or other hinge 25 which enables the projectile to fold back upon itself and against a raised edge 24 rising at right angles to the plane of one wall so as to act as a fulcrum upon which the pressed wall 26 may bend until released and launch the projectile toward the target A, B. In an additional flat design 23, the projectile is defined by a plastic or other hinge 27 which enables the projectile to fold back upon itself to a limited point after which the wall 28 may bend with the hinge 27 as the fulcrum point from which the pressed wall 28 may bend until released and launch the projectile toward the target A, B.

The variety of ways in which the projectile of the present invention can hook and latch itself 4, 5, 6, 7 to the raised edge A' or B' of a target receptacle A or B, can be seen from the two receptacles A, B shown in FIGS. 1A and 1B. Each way can count as a different score. For example, in a game, one hook hanging inside the receptacle A or B with the base 5A of the fork resting on the edge or outside could count as one point; a two point score could be indicated by both hooks hanging 4 on the inside of the receptacle A or B, or the base 6 hanging on the inside of receptacle A or B; a three point score could be indicated by a hook and base 7 hanging on the inside of the receptacle A or B. When the entire projectile falls into the receptacle A or B, it could count as 4 points. The winner of such a game, would be the highest scorer after a given number of attempts, or the first to reach a given score such as 21 points, after an equal number of attempts by all the players.

It is obvious that upon study by those skilled in the art the disclosed invention may be altered or modified in other manners without departing from its inventive concept.

I claim:

1. In a game of the type having a game target receptacle with a raised edge, an integral one piece projectile playing element bent so as to have a first planar portion and a second planar portion forming an acute angle with one end of said first planar portion, said first planar portion being V-shaped and said second planar portion being extensions of the legs of said first portion, said projectile being composed of a resilient material so allowing it to act as a spring which when pressed and released may launch said projectile towards said game target receptacle, whereby a score may be obtained when said projectile is received completely within said receptacle or when said first and second portions hook over the raised edge of said game target receptacle.

2. A game according to claim 1, wherein a trademark or other advertising information is placed upon said projectile in order to give it value as an item for advertising as well as a playing piece for a game.

3. The game according to claim 1, wherein said first and second planar portions are joined by integral hinge means.

4. The game piece according to claim 3, wherein a raised element is provided on the inside surface of one of said first and second portions, said raised element acting as a fulcrum upon which the pressed portion may be bent until said projectile is released.

5. In a game of the type having a game target receptacle with a raised edge, an integral one piece projectile playing element bent so as to have a first planar portion and a second planar portion forming an acute angle with one end of said first planar portion, said projectile comprising an open rectangle shaped member folded back upon itself to form said first and second portions, said projectile being composed of a resilient material so allowing it to act as a spring which when pressed and released may launch said projectile toward said game target receptacle, whereby a score may be obtained when said projectile is received completely within said receptacle or when said first and second portions hook over the raised edge of said game target receptacle.

6. In a game of the type having a game target receptacle with a raised edge, an integral one piece projectile playing element bent so as to have a first planar portion and a second planar portion forming an acute angle with one end of said first planar portion, said projectile comprising an open 0-shaped circular member folded back upon itself to form said first and second portions, said projectile being composed of a resilient material so allowing it to act as a spring which when pressed and released may launch said projectile toward said game target receptacle, whereby a score may be obtained when said projectile is received completely within said receptacle or when said first and second portions hook over the raised edge of said game target receptacle.

* * * * *